US007786361B1

(12) United States Patent
Foltz

(10) Patent No.: US 7,786,361 B1
(45) Date of Patent: Aug. 31, 2010

(54) WOOD ON GRAPHITE LAYUP INSTRUMENTS

(76) Inventor: David Foltz, 503 S. Essex La., Mesa, AZ (US) 85206

( * ) Notice: Subject to any disclaimer, the term of this patent is extended or adjusted under 35 U.S.C. 154(b) by 0 days.

(21) Appl. No.: 12/478,881

(22) Filed: Jun. 5, 2009

(51) Int. Cl.
*G10D 3/00* (2006.01)

(52) U.S. Cl. ..... 84/291; 84/267

(58) Field of Classification Search ..... 84/267, 84/290, 291, 293
See application file for complete search history.

(56) References Cited

U.S. PATENT DOCUMENTS 3,880,040 A 4/1975 Kaman
4,161,130 A 7/1979 Lieber
D254,621 S 4/1980 Bolen
5,333,527 A * 8/1994 Janes et al. ..... 84/291
6,664,452 B1 12/2003 Teel
6,774,292 B2 8/2004 Mace
6,833,501 B2 12/2004 Jagmin
7,151,210 B2 * 12/2006 Janes et al. ..... 84/291
7,276,868 B2 10/2007 Allred, III
7,282,630 B2 10/2007 Van Vliet

* cited by examiner

*Primary Examiner*—Kimberly R Lockett
(74) *Attorney, Agent, or Firm*—Kyle Fletcher

(57) ABSTRACT

A wood on graphite layup instrument includes a soundboard, reinforced bridge, and neck made of reinforced plies of graphite fibers. The outer surface of the instrument is adorned with a wood veneer for a finished look that resembles a traditional instrument, such as a guitar.

9 Claims, 4 Drawing Sheets

WOOD ON GRAPHITE LAYUP INSTRUMENTS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of instruments, more specifically, an instrument made of a plurality of graphite layers and wood veneers.

B. Discussion of the Prior Art

As a preliminary note, it should be stated that there is an ample amount of prior art that deals with instruments. As will be discussed immediately below, no prior art discloses an instrument that involves a plurality of graphite layers along with a veneer layer and of which includes a honeycomb layer sandwiched amongst the graphite layers.

The Mace patent (U.S. Pat. No. 6,774,292) discloses a graphite/carbon fiber and wood neck for stringed musical instruments. However, the disclosure is limited to just the neck of the musical instrument, and not the body of the instrument, which includes the bridge.

The Lieber patent (U.S. Pat. No. 4,161,130) discloses a bowl-shaped body formed in a single piece of graphite, fiberglass, or impregnated fabric. However, the disclosure of the Lieber patent is directed only to the body, and not an entire instrument, including the neck being made of a plurality of layers of graphite fiber.

The Janes et al. patent discloses an improved guitar soundboard that is made of a plurality of layers of epoxy impregnated graphite fibers. Again, the content of the Janes patent is limited to the soundboard and does not include a corresponding neck of the instrument.

The Teel patent (U.S. Pat. No. 6,664,452) discloses an acoustic guitar constructed with a pre-finished graphite soundboard and a pre-finished high pressure laminate backboard and sidewall. Again, the guitar of the Teel patent is limited to the soundboard and does not include a corresponding neck of the instrument.

The Jagmin patent (U.S. Pat. No. 6,833,501) discloses an acoustic guitar assembly that includes graphite rods and graphite ribs. However, the guitar does not include a soundboard made of graphite layers with a bridge reinforcement made of graphite layers.

The Kaman patent (U.S. Pat. No. 3,880,040) discloses a multiple ply soundboard for a guitar that is made of inner and outer plies of oriented graphite fiber material. Again, the disclosure is limited to a soundboard, and not a bridge reinforcement and neck made of or with reinforced graphite fibers.

The Alfred, III patent (U.S. Pat. No. 7,276,868) discloses a carbon-fiber laminate musical instrument sound board, which does not disclose a bridge reinforcement or neck made of or with reinforced graphite fibers.

The Van Vliet patent (U.S. Pat. No. 7,282,630) discloses a soundboard for a musical instrument comprising nanostructured aluminum materials. However, the soundboard is made of aluminum as opposed to a plurality of layers of reinforced graphite fibers.

While the above-described devices fulfill their respective and particular objects and requirements, they do not describe a wood on graphite layup instrument that includes a soundboard and reinforced bridge composed of several layers of reinforced graphite fibers and a neck that utilizes a plurality of graphite rods or reinforced plies. In this regard, the wood on graphite layup instrument departs from the conventional concepts and designs of the prior art.

SUMMARY OF THE INVENTION

A wood on graphite layup instrument includes a soundboard, reinforced bridge, and neck made of reinforced plies of graphite fibers. The outer surface of the instrument is adorned with a wood veneer for a finished look that resembles a traditional instrument.

An object of the invention is to provide a layup instrument that is made of a plurality of layers of reinforced graphite fibers in order to add strength to the frame of the instrument.

These together with additional objects, features and advantages of the wood on graphite layup instrument will be readily apparent to those of ordinary skill in the art upon reading the following detailed description of presently 10 preferred, but nonetheless illustrative, embodiments of the wood on graphite layup instrument when taken in conjunction with the accompanying drawings.

In this respect, before explaining the current embodiments of the wood on graphite layup instrument in detail, it is to be understood that the wood on graphite layup instrument is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the wood on graphite layup instrument.

It is therefore important that the claims be regarded as including such equivalent construction insofar as they do not depart from the spirit and scope of the wood on graphite layup instrument. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
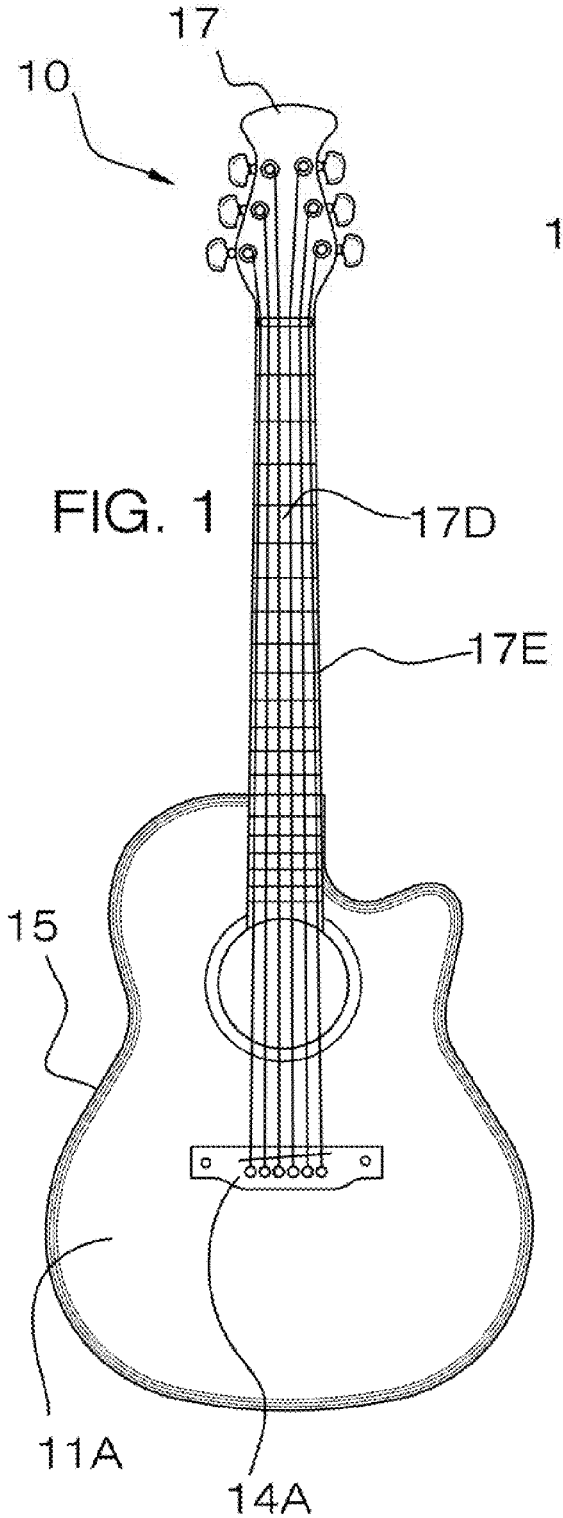
FIG. 1 illustrates a front view of the invention.
Figure 2:
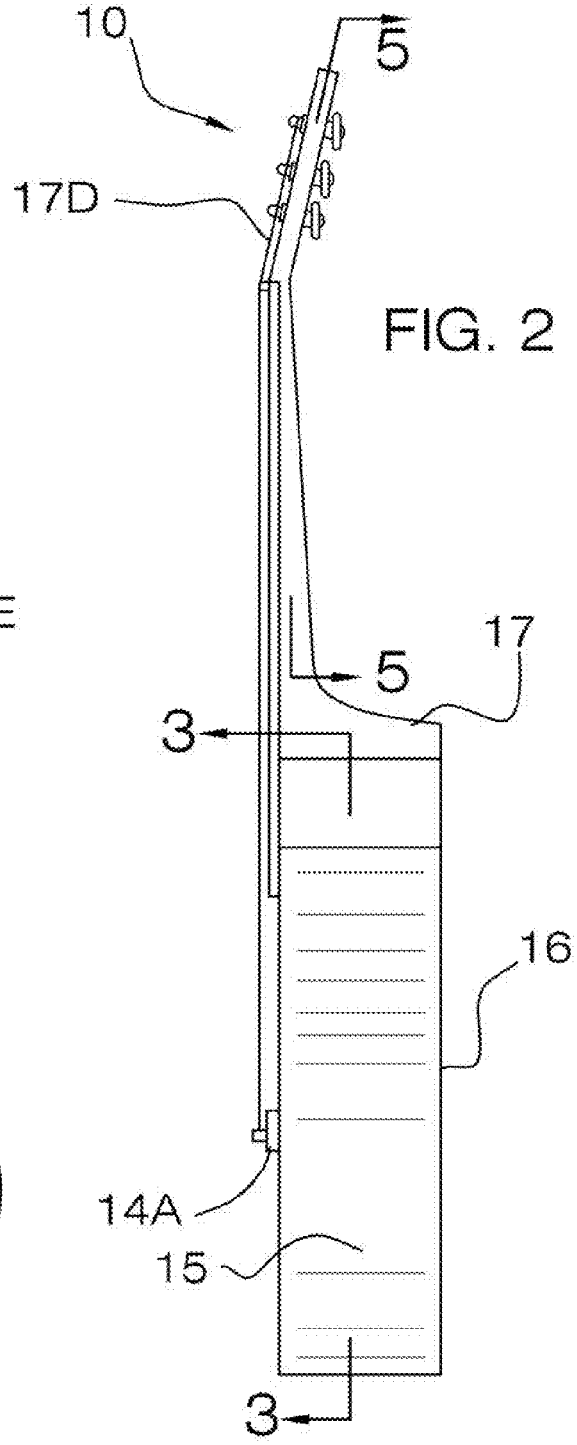
FIG. 2 illustrates a side of the invention.
Figure 3:
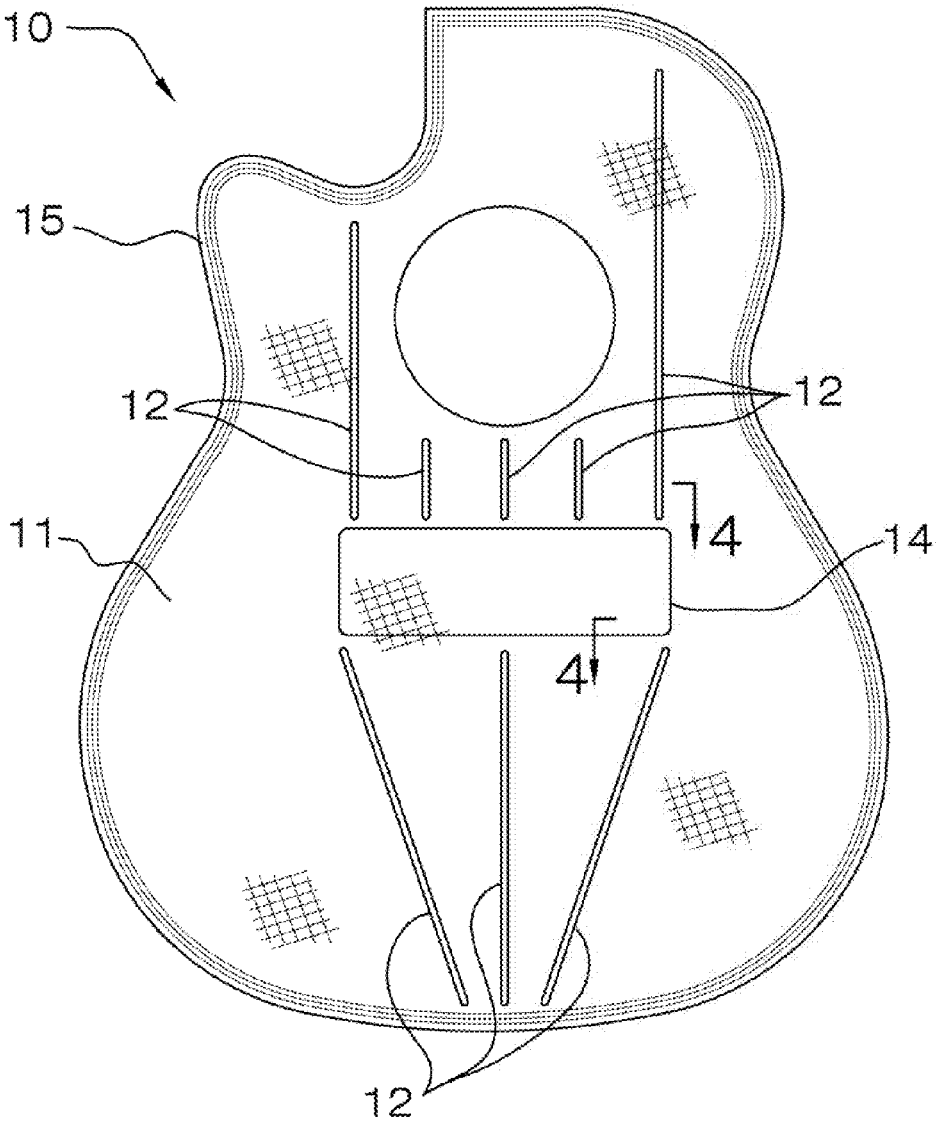
FIG. 3 illustrates a cross-sectional view of the soundboard and the bridge reinforcements along line 3-3 in FIG. 2.

Detailed reference will now be made to the preferred embodiment of the present invention, examples of which are illustrated in FIGS. 1-5. A wood on graphite layup instrument 10 (hereinafter invention) includes a soundboard 11 that has a plurality of plies of a reinforced carbon graphite fabric.

The soundboard 11 has a plurality of reinforcing ribs 12. The reinforcing ribs 12 are composed of a uni-tape tubing that is split in half, and adhered to the inner surface of the soundboard 11. The invention 10 also includes a bridge reinforcement 14, a plurality of sides 15, and a rear 16.

Figure 4:
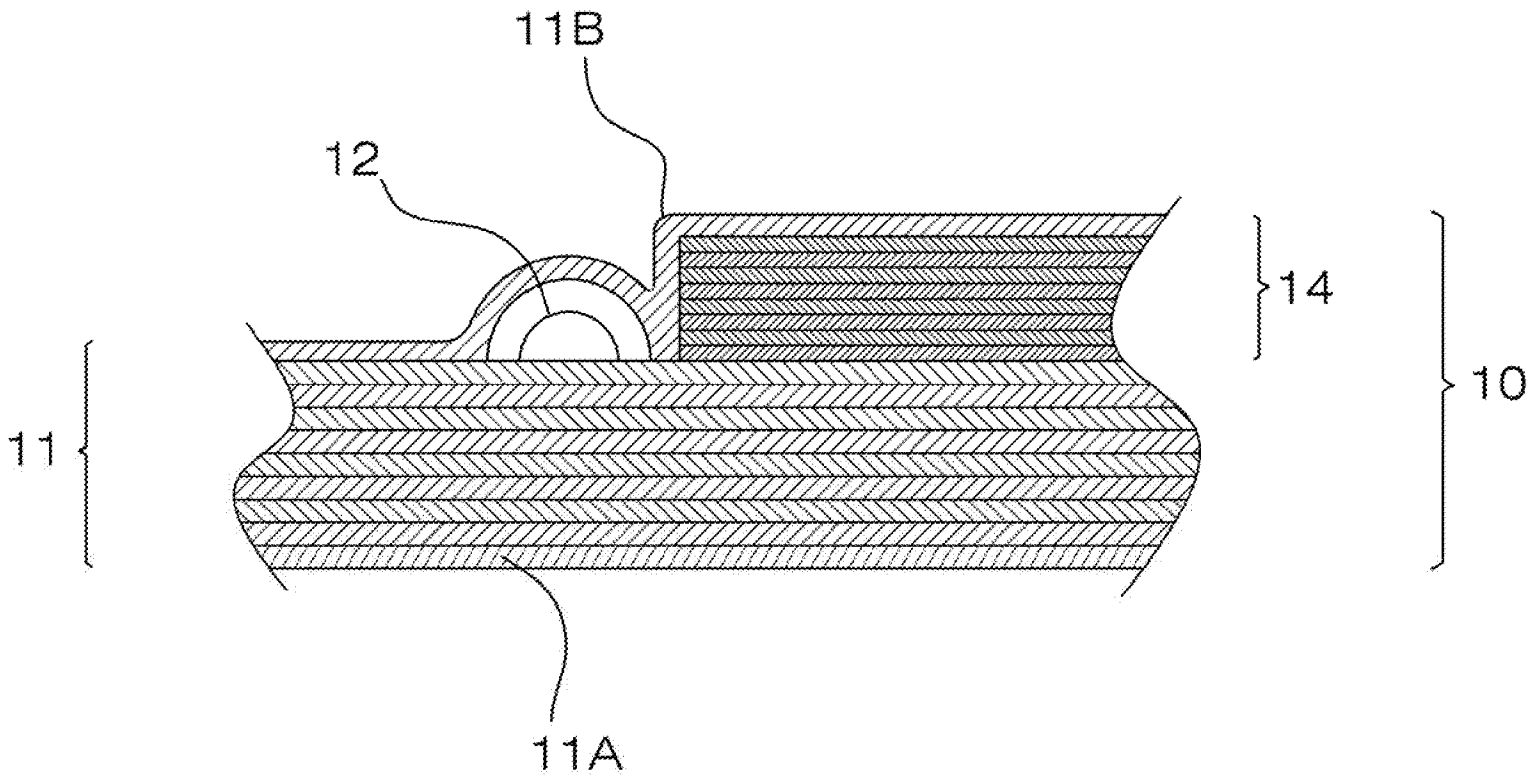
FIG. 4 illustrates a detailed cross-sectional view of the soundboard along line 4-4 in FIG. 3 further detailing each layer consisting of veneer, reinforcements, and graphite layer.
Figure 5:
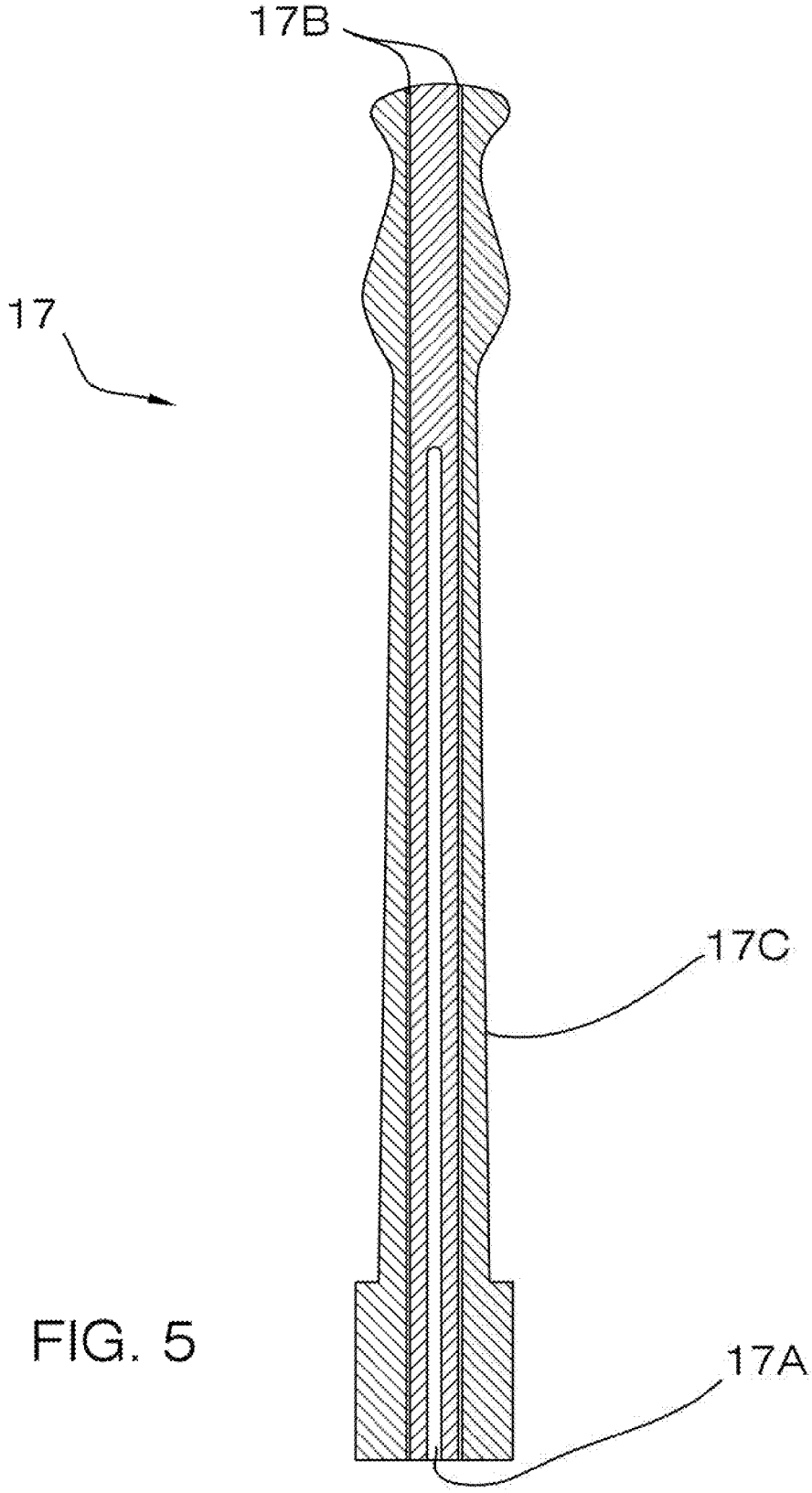
FIG. 5 illustrates a cross-sectional view of the neck along line 5-5 in FIG. 2.

The bridge reinforcement 14 is composed of a plurality of layers of carbon graphite fabric. However, it shall be noted that FIG. 4 depicts the bridge reinforcement 14 being composed of eight layers of carbon graphite fabric. The bridge reinforcement 14 fits inside of the invention 10 and supports a bridge 14A along an exterior surface of the soundboard 11.

The sides 15 are composed of six layers of carbon graphite fabric, a wood veneer layer, and a honeycomb layer that is sandwiched in the middle of the six layers of carbon graphite fabric. The rear 16 is composed of a wood veneer, and 7 layers of carbon graphite fabric.

A neck 17 has a truss rod groove 17A, and two runners 17B made up of five plies of carbon graphite fabric. The neck 17 also includes a layer of wood 17C, which is further comprised of three pieces of ¾" thick wood. A truss rod, not depicted, composed of a metal, runs along the truss rod grooves 17A: The use of carbon graphite fabric in the neck 17 insures that guitar strings 17D stay in tune longer, and also stabilizes the wood 17C. Guitars include a truss rod, which bends the neck 17 in order to prevent guitar strings 17D from touching the frets 17E when vibrating.

The process of making the soundboard 11 involves the following layup procedures. A beginning layer 11B consisting of a 0.020 thick wood veneer is positioned on a flat tool surface, and the wood veneer absorbs the epoxy during the curing process mentioned below. The 0.020 thick wood veneer provides a wood appearance to the instrument as well as a sound of wood as with a traditional guitar. (2) Place a 0.010 layer of carbon graphite fabric 11B down with a ply orientation of 0/90 degree in relation to the wood grain. (3) Place a 0.010 layer of carbon graphite fabric 11B down with a ply orientation of 45 degree in relation to the wood grain. (4) Place a 0.010 layer of carbon graphite fabric 11B down with a ply orientation of −45 degree in relation to the wood grain. (5) Place a 0.010 layer of carbon graphite fabric 11B down with a ply orientation of 45 degree in relation to the wood grain. (6) Place a 0.010 layer of carbon graphite fabric 11B down with a ply orientation of −45 degree in relation to the wood grain. (7) Place a 0.010 layer of carbon graphite fabric 11B down with a ply orientation of 0/90 degree in relation to the wood grain. (8) Place a 0.010 layer of carbon graphite fabric 11B down with a ply orientation of 0/90 degree in relation to the wood grain. (9) Install the reinforcing ribs 12. (10) Place a 0.010 layer of carbon graphite fabric 11B down with a ply orientation of 0/90 degree in relation to the wood grain. (11) Next, insert the assembly inside of a vacuum bag and cure. The assembly refers to the soundboard 11, the reinforcing ribs 12, the bridge reinforcement 14, the sides 15, the rear 16, and the neck 17. The assembly shall be cured in an oven at 150 degrees Fahrenheit for 30 minutes or until the epoxy cures properly.

The term reinforced, carbon graphite fabric is used to denote the process by which a series of layers of carbon fibers are laid out on top of each other, and upon which a layer of an epoxy resin is spread thereabout. Thereafter, the epoxy resin and layers of carbon fibers are placed inside of a vacuum-sealed chamber or bag in order to cure.

Referring to FIG. 4, the soundboard 11 is comprised of a veneer layer 11A, seven layers of reinforced graphite fiber plies 11B, the plurality of reinforcing ribs 12, the bridge reinforcement 14, and an eight layer of graphite fiber.

FIG. 4 depicts the reinforcing ribs 12 being composed of eight layers of the reinforced carbon fiber plies 12A. However, it shall be noted that the tone of the soundboard 11 may be altered by adjusting the number of plies 11B used or by adjusting the placement of the reinforcing ribs 12.

With respect to the above description, it is to be realized 22 that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

While the embodiments of the invention have been disclosed, certain modifications may be made by those skilled in the art to modify the invention without departing from the spirit of the invention.

The inventor claims:

1. A layup musical instrument comprising:

a soundboard is comprised of a wood veneer and a plurality of layers of carbon graphite fabric;

a bridge reinforcement is comprised of a plurality of layers of carbon graphite fabric, and is placed against said soundboard for support of a bridge;

a plurality of reinforcing ribs are each comprised of a semi-circular carbon-graphite tubing;

a series of sides and a rear make up a body that supports the soundboard, bridge reinforcement, and reinforcing ribs;

wherein the soundboard is comprised of 8 layers of carbon graphite fabric, a wood veneer, and of which the reinforcing ribs and bridge reinforcement are placed along an interior surface and of which a ninth layer of carbon graphite fabric is placed over the soundboard, the reinforcing ribs, and the bridge reinforcement;

wherein the bridge reinforcement is comprised of 8 layers of a carbon graphite fabric;

wherein the sides are comprised of a wood veneer, 3 layers of a carbon graphite fabric, a honeycomb layer, and another 3 layers of a carbon graphite fabric;

wherein the rear is comprised of a wood veneer and 7 layers of a carbon graphite fabric;

and a neck that is made of a wood, two runners of reinforced carbon graphite fabric, a plurality of truss rod grooves, and truss rods.

2. The layup musical instrument as described in claim 1 wherein the wood veneer is made of a maple or black walnut wood of at least a 0.020 thickness.

3. The layup musical instrument as described in claim 1 wherein the carbon graphite fabric is 0.010 in thickness.

4. The layup musical instrument as described in claim 1 wherein the sides are vacuumed and cured in an oven.

5. The layup musical instrument as described in claim 1 wherein the rear is vacuumed and cured in an oven.

6. The layup musical instrument as described in claim 1 wherein the soundboard is vacuumed and cured in an oven.

7. A layup musical instrument comprising:

a soundboard is comprised of a wood veneer and a plurality of layers of carbon graphite fabric;

a bridge reinforcement is comprised of a plurality of layers of carbon graphite fabric, and is placed against said soundboard for support of a bridge;

a plurality of reinforcing ribs are each comprised of a semi-circular carbon-graphite tubing;

a series of sides and a rear make up a body that supports the soundboard, bridge reinforcement, and reinforcing ribs;

wherein the soundboard is comprised of 8 layers of carbon graphite fabric, a wood veneer, and of which the reinforcing ribs and bridge reinforcement are placed along an interior surface and of which a ninth layer of carbon graphite fabric is placed over the soundboard, the reinforcing ribs, and the bridge reinforcement; and wherein the soundboard is vacuumed and cured in an oven;

wherein the bridge reinforcement is comprised of 8 layer of a carbon graphite fabric;

wherein the sides are comprised of a wood veneer, 3 layers of a carbon graphite fabric, a honeycomb layer, and another 3 layers of a carbon graphite fabric before the sides are vacuumed and cured in an oven;

wherein the rear is comprised of a wood veneer and 7 layers of a carbon graphite fabric before the rear is vacuumed and cured in an oven;

a neck that is made of a wood, two runners of reinforced carbon graphite fabric, a plurality of truss rod grooves, and truss rods.

8. The layup musical instrument as described in claim 7 wherein the wood veneer is made of a maple or black walnut wood of at least a 0.020 thickness.

9. The layup musical instrument as described in claim 7 wherein the carbon graphite fabric is 0.010 in thickness.

* * * * *